US007837489B2

(12) United States Patent
Kameda

(10) Patent No.: US 7,837,489 B2
(45) Date of Patent: Nov. 23, 2010

(54) ELECTRICAL CONNECTOR

(75) Inventor: Yasutoshi Kameda, Chiba (JP)

(73) Assignee: FCI, Versailles (FR)

( * ) Notice: Subject to any disclaimer, the term of this patent is extended or adjusted under 35 U.S.C. 154(b) by 0 days.

(21) Appl. No.: 12/226,590

(22) PCT Filed: Feb. 27, 2007

(86) PCT No.: PCT/JP2007/053617

§ 371 (c)(1),
(2), (4) Date: Mar. 19, 2010

(87) PCT Pub. No.: WO2007/125679

PCT Pub. Date: Nov. 8, 2007

(65) Prior Publication Data

US 2010/0184319 A1 Jul. 22, 2010

(30) Foreign Application Priority Data

Apr. 28, 2006 (JP) ..... 2006-125590

(51) Int. Cl.
*H01R 13/15* (2006.01)

(52) U.S. Cl. ..... 439/260

(58) Field of Classification Search ..... 439/260, 439/495

See application file for complete search history.

(56) References Cited

U.S. PATENT DOCUMENTS

| | | | | |
|---|---|---|---|---|
| 6,666,711 | B2 * | 12/2003 | Takashita et al. | 439/495 |
| 6,726,497 | B2 * | 4/2004 | Nogawa et al. | 439/260 |
| 7,086,884 | B2 * | 8/2006 | Okano | 439/260 |
| 2004/0002254 | A1 | 1/2004 | Tsunematsu | 439/495 |
| 2006/0141837 | A1 | 6/2006 | Okano | 439/260 |

FOREIGN PATENT DOCUMENTS

| | | | |
|---|---|---|---|
| EP | 1 378 966 | A1 | 1/2004 |
| EP | 1 566 861 | A1 | 8/2005 |
| JP | 3619822 | B2 | 11/2004 |
| JP | 200535808 | | 2/2005 |
| WO | WO-2004/049514 | A1 | 6/2004 |

* cited by examiner

*Primary Examiner*—Tho D Ta
(74) *Attorney, Agent, or Firm*—Harrington & Smith

(57) ABSTRACT

A novel electrical connector that is thin and can hold a belt-like body. The electrical connector has two kinds of contact elements. When an actuator is rotated, an operation section of the actuator presses one connector element downward, and force from the one connector element causes the rotation shaft of the actuator to move upward. As a result, a portion near one end of a bar-like section, supported in air, of the other contact element is elastically deformed upward. By the principle of leverage, a portion near the other end of a bar-like section of the other contact element is moved downward.

5 Claims, 5 Drawing Sheets

ELECTRICAL CONNECTOR

TECHNICAL FIELD

The present invention relates to an electrical connector to form electrical contacts upon gripping a flexible ribbon-shaped element (for example, a flat flexible cable) having electrical wires, and more in particular to an electrical connector provided with contact elements arranged so as to form a staggered array of contacts at a predetermined interval.

BACKGROUND ART

Conventionally, a ribbon-shaped element having electrical wires such as printed wire and the like is used for various electrical wires in terms of thinness or flexibility. The electrical wires of the ribbon-shaped element are electrically connected to electrical wires of a printed circuit board or the like via an electrical connector. The electrical connector is provided with a plurality of contact elements within a housing thereof and an operating portion which is so-called a rotating actuator, and the contact elements are elastically deformed by a rotational movement of the actuator to grip the ribbon-shaped element at a predetermined position of the contacts.

An electrical connector provided with two types of contact elements is disclosed in Patent Document 1. Two types of contact elements form a contact array with a predetermined interval with respect to insertion direction of a ribbon-shaped element. A first contact element is connected to an end side thereof with an upper beam and a lower beam in a cantilever form, and a second contact element is connected to an end side thereof with an upper beam and a lower beam in a cantilever form with a rod-shaped beam supported in a pendant fashion by a terminal end portion and a connecting portion of the upper beam. In respect to the upper beam of the first contact element and the rod-shaped beam of the second contact element, both are locked with a moving portion which rotates around the shaft of the actuator.

When describing an open state of the actuator, in the first contact element, since a sectional portion in a long direction of the moving portion of the actuator deforms as if pushing up the upper beam, the opposing gap between the upper beam and the lower beam is widened. In the second contact element, a sectional portion in a short direction of the moving portion of the actuator is locked with the vicinity of one end portion of the rod-shaped beam, and the vicinity of the other end portion thereof forming the contacts with the ribbon-shaped element is positioned such that it is spaced away from the lower beam with an interval that is approximately the same as the thickness of the ribbon-shaped element.

Subsequently, when describing a closed state of the actuator, in the first contact element, the sectional portion in a short direction of the moving portion of the actuator is locked with the upper beam, and thus the upper beam recovers elastically to narrow the opposing interval between the upper beam and the lower beam. In the second contact element, since the sectional portion in a long direction of the moving portion of the actuator deforms as if pushing up the vicinity of the one end portion of the rod-shaped beam, the vicinity of the other end portion forming the contacts with the ribbon-shaped element is positioned in an direction approaching the lower beam compared with the open state of the actuator according to the lever principle. In this way, two kinds of contact elements can grip the ribbon-shaped element.

In the electrical connector disclosed in Patent Document 1, a structure is realized that, when the ribbon-shaped element is inserted in the open state of the actuator, the ribbon-shaped element is contacted to the vicinity of the other end portion of the rod-shaped beam of the second contact element and is inserted with a low insertion force (hereinafter, abbreviated to "LIF"), as well as is inserted with a zero insertion force (hereinafter, abbreviated to "ZIF") with no contact to the first contact element. The structure has an advantage that, when the actuator changes to a closed state after inserted with no load due to the ribbon-shaped element having flexibility, two kinds of the contact elements grip the ribbon-shaped element at the same time to prevent a bending of the ribbon-shaped element.

Patent Document 1: Japanese Patent Publication No. 3619822

DISCLOSURE OF THE INVENTION

Problem that the Invention is to Solve

Since the electrical connector related to Patent Document 1, in the first contact element, has a structure in which the part locked with the moving portion of the actuator is formed in a hook shape and the ribbon-shaped element is inserted by pushing up the upper beam in the open state of the actuator, a wider interval in respect to the thickness of the housing of the electrical connector is required to secure an operating range of the upper beam. As a result, the thickness of the housing becomes greater, and thus the entire electrical connector may become large.

In addition, the electrical connector having the above-described advantage is demanded to be supplied in a variety of types in industry field.

Means for Solving the Problem

Therefore, an object of the present invention is to provide an electrical connector with a novel shape which contributes to a reduction of the thickness of the electrical connector, by limiting the variable moving range of the upper beam in the first contact element such that the upper beam does not move in the direction away from the lower base beam during the opening/closing of the actuator, and by providing a structure in which a locking part is locked with the moving part of the actuator in the pendent support part, which is unrelated to the thickening of the thickness of the electrical connector, in the second contact element.

Furthermore, the up and down directions referred in this specification only relates to relative positions for the sake of convenience. In addition, any rotations, up-down reversals, 90° turnings of the invented subject are considered within the technical range of the invention.

(1) In order to accomplish the above-described object, an electrical connector according to the present invention comprises:

a first contact element provided with a first rod-shaped base portion, a first supporting piece having a base end in the vicinity of one end portion of the first rod-shaped base portion and extending in the direction of the other end portion of the first rod-shaped base portion while spaced from the first rod-shaped base portion via an upwardly extending support portion, a first leg portion extending from a terminal end portion of the first supporting piece in the direction of the other end portion of the first rod-shaped base portion, and a second leg portion extending from the terminal end portion of the first supporting piece in the direction of the one end portion of the first rod-shaped base portion;

a second contact element provided with a second rod-shaped base portion, and a second supporting piece having a terminal end portion extending in the direction of the other end portion of the second rod-shaped portion while spaced from the second rod-shaped base portion via an upwardly extending support portion having a base end in the vicinity of one end portion of the second rod-shaped base portion, a housing into which the first contact element and the second contact element are inserted; and a rotating actuator comprising a shaft portion detained against the first leg portion on a lower side, and a moving portion that locks with an upper side of the vicinity of the terminal end portion of the second supporting piece upon rotation about the shaft;

wherein the rotation causes the moving portion to press against the vicinity of the terminal end portion of the second supporting piece and a reactive force against the pressing force causes the shaft portion to move upward.

(2) According to the electrical connector of the present invention, the terminal portion of the second leg portion preferably moves downward due to the upward movement of the shaft portion of the rotating actuator.

(3) In addition, according to the electrical connector of the present invention, the first contact element and the second contact element are preferably inserted to the housing from opposite directions.

(4) According to the electrical connector of the present invention, the first contact element and second contact element are preferably arranged so as to form a staggered array of contacts at positions that are spaced from each other in the direction of insertion into the housing.

(5) According to an electrical connector of the present invention, the housing has an insertion port for insertion of a ribbon-shaped element, and the array of contacts is such that the contacts of the first contact elements are positioned further in a direction of insertion of the ribbon-shaped element with respect to the contacts of the second contact elements.

ADVANTAGE OF THE INVENTION (1) The present invention can provide an electrical connector of novel shape, capable of operating cooperatively with two types of contact elements by the structure in which the rotation of the rotating actuator causes the moving portion to press against the vicinity of the terminal end portion of the second supporting piece of the second contact element, and a reactive force against the pressing force causes the shaft portion to move upward, so the first leg portion of the first contact element moves upwardly.

In addition, in the electrical connector according to the present invention, since the vicinity of the terminal end portion of the second supporting piece of the second contact element moves downwardly only, it cannot be a factor in thickening the thickness of the electrical connector, and by designing the supporting point of the first leg portion and the second leg portion of the first contact element and the first supporting piece so as to be positioned in the lower side, it also contributes to the reduction of the thickness of the electrical connector.

(2) In the electrical connector according to the present invention, since the terminal end portion of the second leg portion moves downward, it can grip the ribbon-shaped element with the first rod-shaped base portion without bending the ribbon-shaped element from the LIF state.

(3) In the electrical connector according to the present invention, since the first contact element and the second contact element are inserted into the housing from opposing directions, the locked portions with the respective contact elements in the housing are formed widely in the arrangement direction of the respective contact elements, which enlarges the locked areas between the respective contact elements and the housing, thereby strengthening the locked areas, as well as readily designing the positions of the contacts between the contact elements and the ribbon-shaped element in the insertion direction.

(4) The electrical connector according to the present invention can narrow the interval between the arrays of the contacts, since staggered contact array are formed.

(5) The electrical connector according to the present invention can shorten the insertion distance of the ribbon-shaped element inserted with the LIF, thereby restricting abrasion in the contacts between the ribbon-shaped element and the first contact elements to a minimum, since the contacts of the first contact elements are positioned further in the direction of insertion of the ribbon-shaped element with respect to the contacts of the second contact elements.

BRIEF DESCRIPTION OF THE DRAWINGS

FIG. 1(*b*) illustrates an entire perspective view of an electrical connector according to the present invention when the actuator is in a closed state; and FIG. 1(*c*) illustrates an entire perspective view of the electrical connector according to the present invention when the actuator is in the closed state with a ribbon-shaped element inserted.

FIG. 2(*b*) illustrates a lateral sectional view of the first contact element of the electrical connector when the actuator is in the closed state.

FIG. 3(*b*) illustrates a lateral sectional view of the second contact element of the electrical connector when the actuator is in the closed state.

FIG. 4(*b*) illustrates a lateral sectional view of the first contact element of the electrical connector when the actuator is in the closed state with a ribbon-shaped element inserted.

FIG. 5(*b*) illustrates a lateral sectional view of the second contact element of the electrical connector when the actuator is in the closed state with a ribbon-shaped element inserted.

DESCRIPTION OF REFERENCE NUMERALS AND SIGNS

1: Electrical Connector
2: First Contact Element
3: Second Contact Element
4: Housing
5: Actuator
6: Guide Plate
7: Shaft Portion
8: Moving Portion
9: Ribbon-Shaped Element.
10: First Rod-Shaped Base Portion
11: First Supporting Piece
12: First Leg Portion

13: Second Leg Portion
14: Support Portion
15: Terminal End Portion
16: Partitioning Portion
17: Terminal End Portion
18: Protruding Portion
20: Second Rod-Shaped Base Portion
21: Second Supporting Piece
24: Support Portion
25: Vicinity of Terminal End Portion
27: Contact Portion

BEST MODE FOR CARRYING OUT THE INVENTION

Hereinafter, embodiments of the present invention will be described with reference to the accompanying drawings. In addition, the same reference numbers are used to refer to the same elements to omit the description thereof appropriately in the respective drawings.

As for the up and down directions used for the embodiments, the up direction refers to the direction receding from the first rod-shaped base portion 10 or the second rod-shaped base portion 20, and the down direction refers to the direction approaching the base portions.

Embodiment 1

Figure 1A:
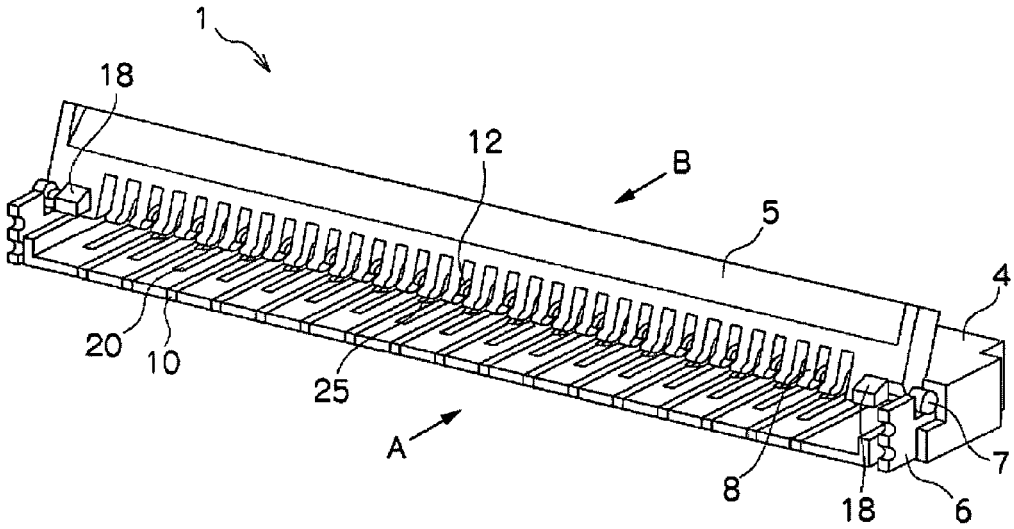
FIG. 1(*a*) illustrates an entire perspective view of an electrical connector according to the present invention when an actuator is in an open state.
Figure 1B:
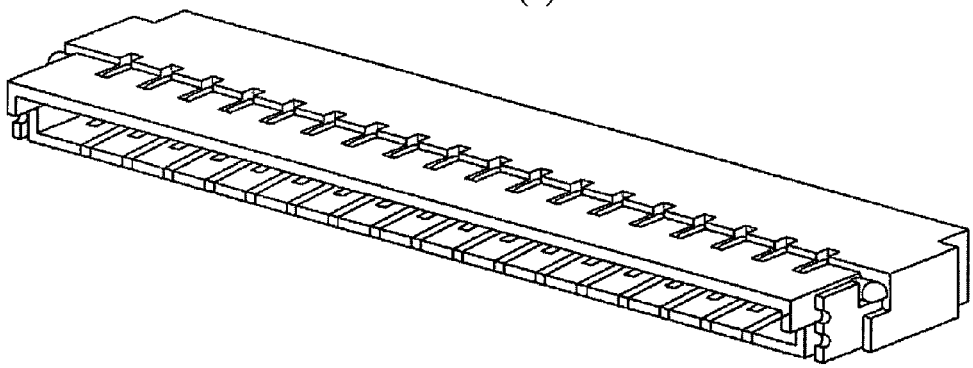
Figure 1C:
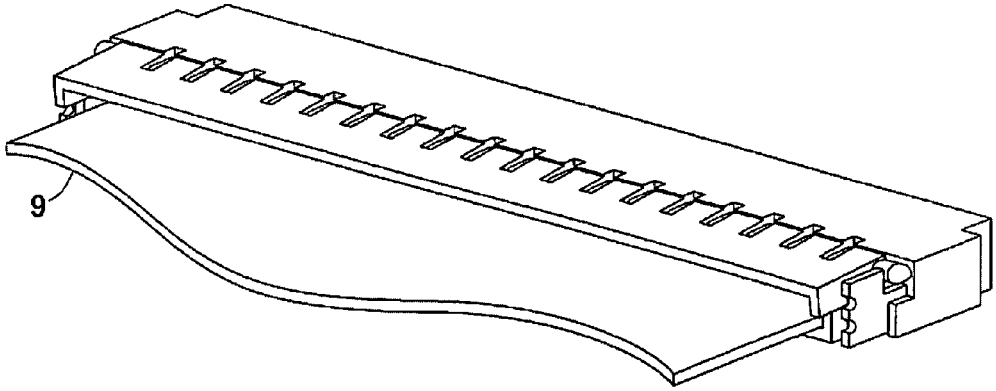

FIG. 1 is an entire perspective view to illustrate an embodiment of an electrical connector 1 according to the present invention; FIG. 1(*a*) illustrates an open state of an actuator 5 described later; FIG. 1(*b*) illustrates a closed state in respect to FIG. 1(*a*); and FIG. 1(*c*) illustrates a closed state with a ribbon-shaped element inserted.

The electrical connector 1 can grip a ribbon-shaped element 9 by rotation to cause an actuator 5 to be closed, when, for example, the ribbon-shaped element 9 such as a film-shaped electrical wire cable or a flexible printed wire cable or the like is inserted from a direction of the arrow A when the actuator 5 is in an open state (see FIG. 1(*c*)).

In addition, the electrical connector 1 is configured to include a plurality of first contact elements 2, a plurality of second contact elements 3, a housing 4, the rotating actuator 5 and a guide plate 6, and the first contact elements 2 and the second contact elements 3 are arranged so as to form a staggered array of contacts with the ribbon-shaped element 9 at positions that are spaced from each other in the direction of insertion into the housing.

Figure 2A:
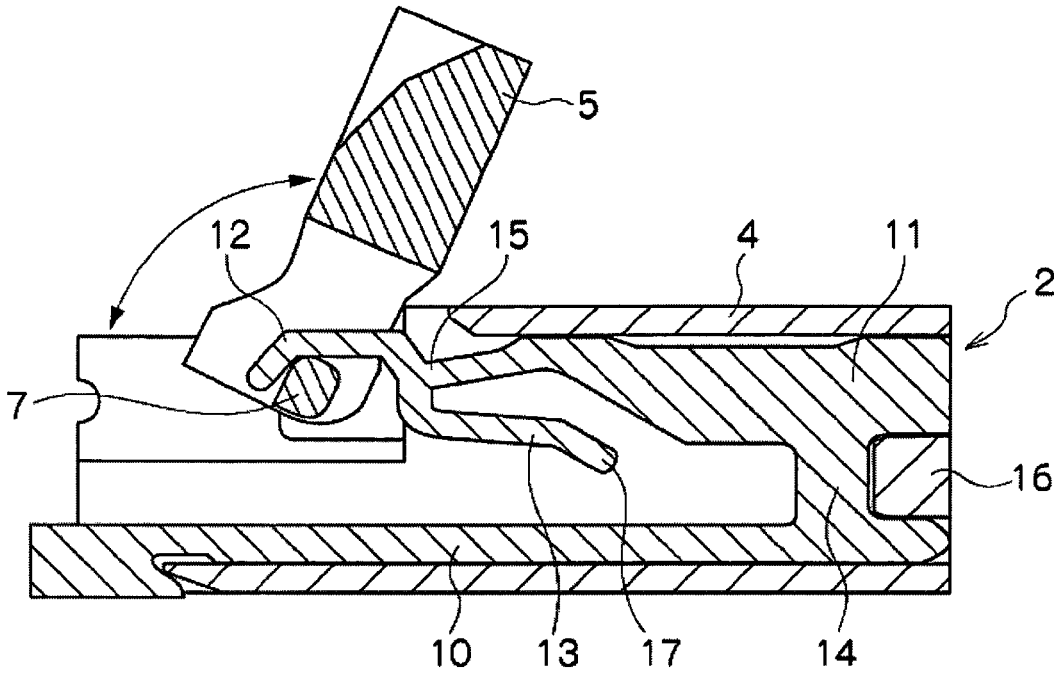
FIG. 2(*a*) illustrates a lateral sectional view of a first contact element of the electrical connector when the actuator is in the open state.
Figure 2B:
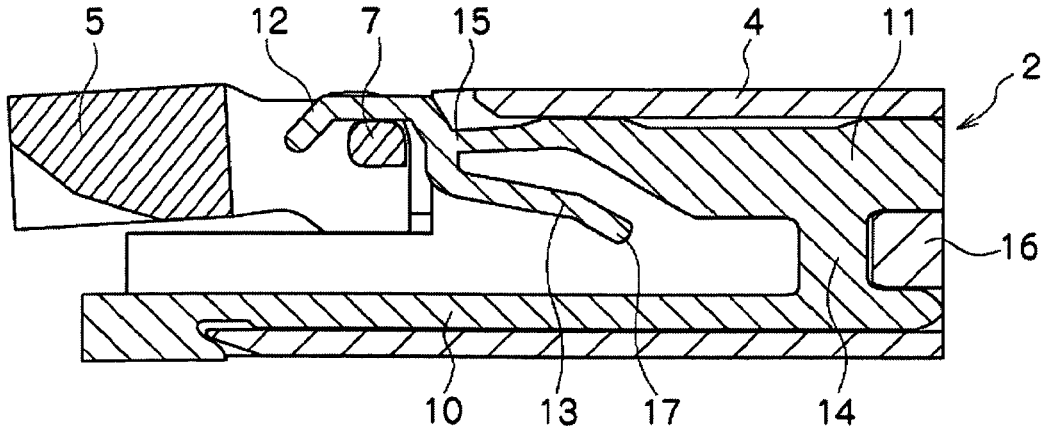

The first contact element 2 is inserted into the housing 4 until it contacts a partitioning portion 16 within the housing 4 along a groove portion from the direction of the arrow A, and is locked and fixed in a circumference of the bottom end of the housing 4 (see FIG. 2).

Figure 3A:
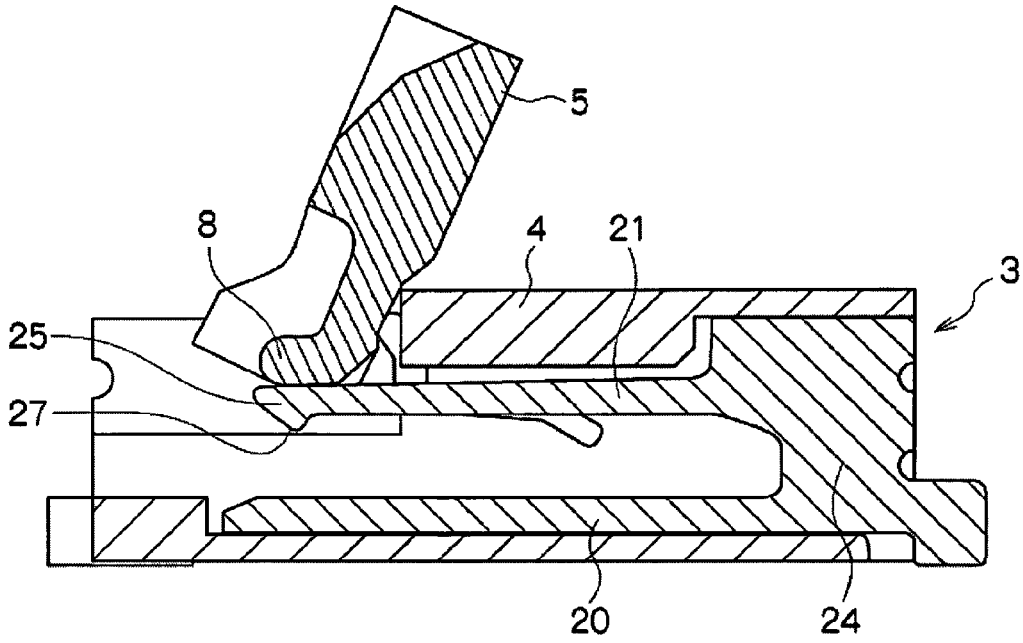
FIG. 3(*a*) illustrates a lateral sectional view of a second contact element of the electrical connector when the actuator is in the open state.
Figure 3B:
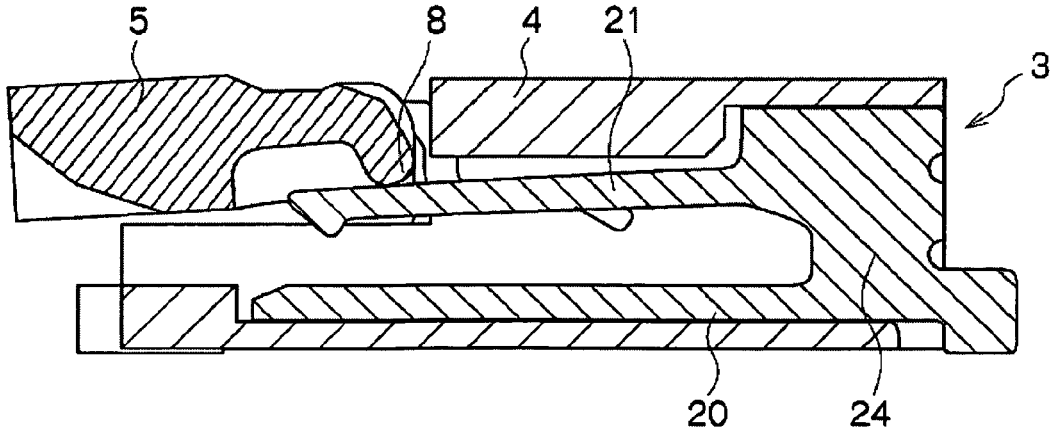

The second contact element 3 is inserted into the housing 4 until it is locked and fixed in a circumference of the bottom end of the housing 4 along a groove portion from the direction of the arrow B opposite to the arrow A (see FIG. 3).

A locked portion between the first contact element and the housing, and a locked portion between the second contact element and the housing, are formed in an edge portion facing each other, to form a wide interval between adjacent contact elements.

The rotating actuator 5 is provided with the shaft portion 7 extending in the direction of the contact arrays in cooperation with the first contact element 2, and a plurality of moving portions 8 arranged in the direction of the contact arrays in cooperation with the second contact element 3 by rotation of the shaft portion 7.

FIG. 2 is sectional views of the first contact element 2 of the electrical connector 1; FIG. 2(*a*) illustrates the actuator in an open state and FIG. 2(*b*) illustrates the actuator in a closed state, without a ribbon-shaped element inserted.

Figure 4A:
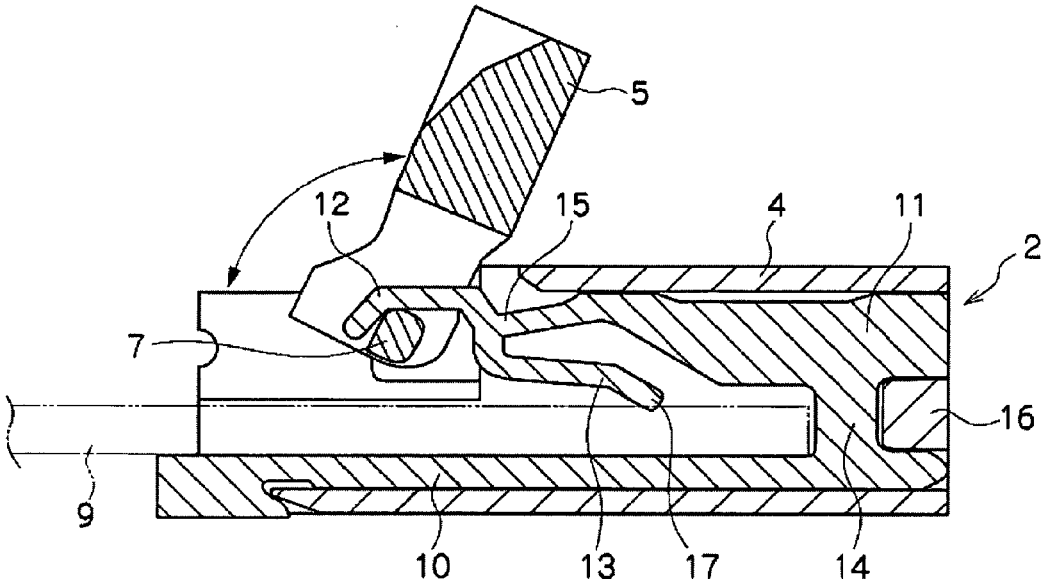
FIG. 4(*a*) illustrates a lateral sectional view of the first contact element of the electrical connector when the actuator is in the open state without a ribbon-shaped element inserted.
Figure 4B:
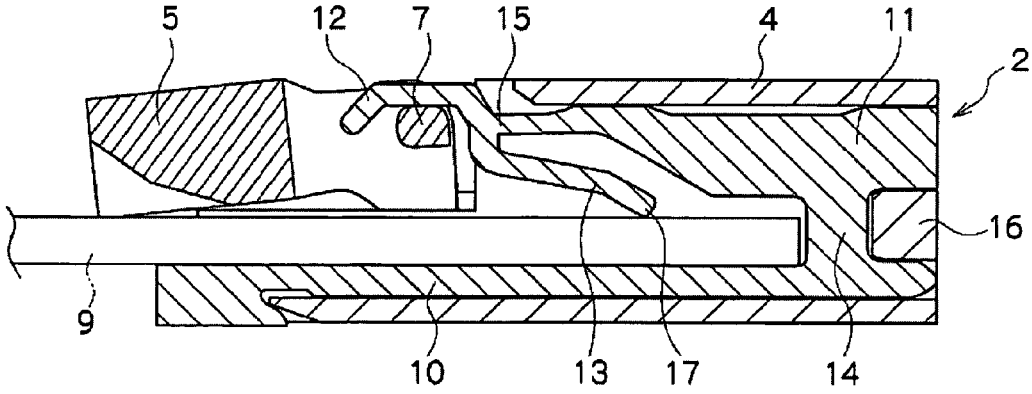

FIG. 4 is sectional views of the first contact element 2 of the electrical connector 1; FIG. 4(*a*) illustrates the actuator in an open state and FIG. 4(*b*) illustrates the actuator in a closed state while gripping the ribbon-shaped element 9, with a ribbon-shaped element inserted.

The first contact element 2 is configured to be positioned, as shown in FIG. 2, in the housing 4 and includes a first rod-shaped base portion 10, a first supporting piece 11, a first leg portion 12 and a second leg portion 13.

The first supporting piece 11 has a base end in the vicinity of one end portion of the first rod-shaped base portion 10 and extends in the direction of the other end portion of the first rod-shaped base portion 10 while spaced from the first rod-shaped base portion 10 via an upwardly extending support portion 14.

The first leg portion 12 extends from a terminal end portion 15 of the first supporting piece 11 in the direction of the other end portion of the first rod-shaped base portion 10, and is formed in a hook shape to be locked with the shaft portion 7, and the second leg portion 13 extends from the terminal end portion 15 of the first supporting piece 11 in the direction of the one end portion of the first rod-shaped base portion 10 while having a tilt angle with the first rod-shaped base portion, and is formed in a rod shape.

The shaft portion 7 of the rotating actuator 5 is positioned in contact with the lower side of the first leg portion 12, which is always locked with the first leg portion 12 even when the shaft portion 7 rotates.

FIG. 3 is sectional views of the second contact element 3 of the electrical connector 1; FIG. 3(*a*) illustrates the actuator in an open state and FIG. 3(*b*) illustrates the actuator in a closed state.

Figure 5A:
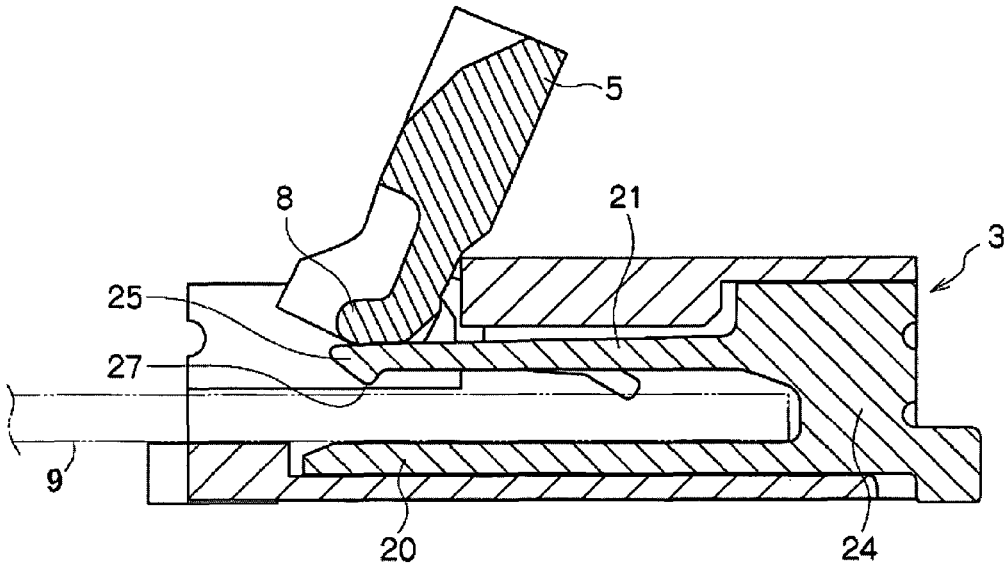
FIG. 5(*a*) illustrates a lateral sectional view of the second contact element of the electrical connector when the actuator is in the open state without a ribbon-shaped element inserted.
Figure 5B:
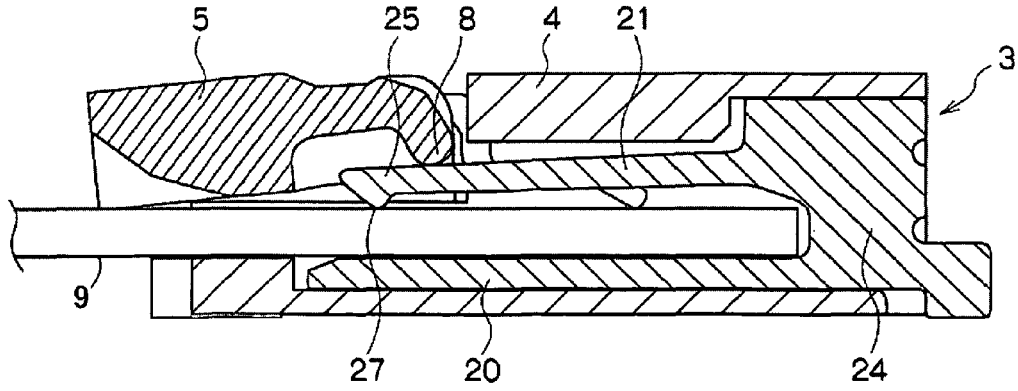

FIG. 5 is sectional views of the second contact element 3 of the electrical connector 1; FIG. 5(*a*) illustrates the actuator in an open state without the ribbon-shaped element inserted and FIG. 5(*b*) illustrates the actuator in a closed state while gripping the ribbon-shaped element 9.

The second contact element 3 is configured to be positioned in the housing 4 and include a second rod-shaped base portion 20 and a second supporting piece 21, as shown in FIG. 3.

The second supporting piece 21 has a terminal end portion 25 extending in the direction of the other end portion of the second rod-shaped portion 20 while spaced from the second rod-shaped base portion 20 via an upwardly extending support portion 24 having a base end in the vicinity of one end portion of the second rod-shaped base portion 20.

The moving portion 8 of the rotating actuator 5 is engaged and supported in an engagement point of an upper side in the vicinity of the terminal end portion 25 of the second supporting piece 21.

The rotating actuator 5 is controlled such that it can move upward and downward in the first leg portion 12 of the first contact element 2 and the vicinity of the terminal end portion 25 of the second supporting piece 21 of the second contact element 3 (see FIGS. 1 to 3), controlled in the directions of A and B by disposition of the shaft portion 7 in a concave portion formed by the housing 4 and the guide plate 6 (see FIG. 1), and further controlled in an extending direction of the shaft portion 7 by the protruding portion 18 and the guide plate 6 (see FIG. 1(*a*)).

Subsequently, when the rotating actuator 5 rotates from an open state to a closed state, the structure in which the first contact element 2 and the second contact element 3 are elastically deformed will be described with reference to FIGS. 2 and 3, and the structure in which the inserted ribbon-shaped element 9 is gripped will be described with reference to FIGS. 4 and 5.

First, the structure in which the contact elements 2 and 3 are elastically deformed will be described. Hereinafter, the ribbon-shaped element is assumed to be not inserted. When the actuator 5 rotates from the open state in FIG. 1(*a*) to the closed state in FIG. 1(*b*), as shown by variation from the state in FIG. 3(*a*) to the state in FIG. 3(*b*), in the second contact element 3, the moving portion 8 presses against the vicinity of the terminal end portion 25 downwardly while moving the engagement point to deform the second supporting piece 21. With this, a distance in a vertical direction relative to the second rod-shaped base portion 20 between a rotational axis point (an axis point of the shaft portion 7) of the moving portion 8 and the engagement point is longer in the closed state than in the open state, and the second supporting piece 21 deforms downwardly as much as the distance. However, a reactive force is applied to the engagement point due to elastic stress of the second supporting piece 21 upwardly. Thus, if the reactive force is greater than the downward pressing force to the shaft portion 7 by the first leg portion 12 of the first contact element 2 in FIG. 2, the shaft portion 7 moves upwardly resisting against the pressing force of the first leg portion 12, resulting in the shaft position in FIG. 2(*b*) from the shaft position in FIG. 2(*a*). As a result, the first leg portion moves upwardly, and, according to the lever principle, the terminal end portion 17 of the second leg portion 13 moves downwardly taking the terminal end portion 15 of the first supporting piece 11 as a supporting point.

However, if the reactive force is smaller than the downward pressing force to the shaft portion 7 by the first leg portion 12, the shaft portion 7 does not move upwardly.

Successively, the structure in which the ribbon-shaped element 9 is inserted in the open state in FIG. 1(*a*) and then the ribbon-shaped element 9 is gripped in the closed state in FIG. 1(*c*) will be described.

As shown in FIG. 1(*a*), the ribbon-shaped element 9 is inserted into a predetermined position in the A direction in the open state of the actuator 5. At this time, the ribbon-shaped element 9 contacts the terminal end portion 17 of the second leg portion 13 within the housing 4 with respect to the first contact element 2 and is inserted with an LIF as if pushing up the terminal end portion 17 of the second leg portion 13 (see FIG. 4(*a*)); with respect to the second contact element 3, it is inserted with a ZIF with no contact thereto (see FIG. 5(*a*)). Since the terminal end portion 17 of the second leg portion 13 moves upwardly by the upward pressing force from the ribbon-shaped element 9 as shown in FIG. 4(*a*), the first leg portion 12 deforms such that a locking point with the shaft portion 7 moves a little downwardly according to the lever principle. This causes the first leg portion 12 to press against the shaft portion 7 downwardly, to thereby increase an locking force thereof.

Subsequently, the actuator 5 rotates to the closed position shown in FIG. 1(*b*). With this, as shown in FIG. 5(*b*), in the second contact element 3, the moving portion 8 of the actuator 5 presses against the vicinity of the terminal end portion 25 of the second supporting piece 21 downwardly for deformation. The deformation causes the terminal end portion 25 to press against the ribbon-shaped element 9 at the contact portion 27. Since the contact portion 27 is given a stress from a surface of the ribbon-shaped element 9 compared with a case of the ribbon-shaped element 9 not inserted, the second supporting piece 21 applies a resultant force of the reactive force due to its own force of restitution and the reactive force from the surface of the ribbon-shaped element 9 to the moving portion 8. If the resultant force is greater than the downward pressing force to the shaft portion 7 by the first leg portion 12 of the first contact element 2 in FIG. 4(*a*), the shaft portion 7 moves upwardly resisting against the downward pressing force of the first leg portion 12, as shown in FIG. 4(*b*). As a result, the first leg portion 12 moves upwardly, and, according to the lever principle, the terminal end portion 17 of the second leg portion 13 moves downwardly taking the terminal end portion 15 of the first supporting piece 11 as a supporting point.

As above, the first contact element 2 strongly grips the ribbon-shaped element 9 since the pressing force is further generated at the terminal end portion 17 from a state of the ribbon-shaped element 9 inserted with the LIF to the ribbon-shaped element 9, as shown in FIGS. 4 and 5, and, the second contact element 3 strongly grips the ribbon-shaped element 9 at the contact portion 27 by the moving portion 8 pressing against the vicinity of the terminal end portion 25 downwardly, as described above.

In the structure of the electrical connector according to the present invention, since a variable range of deformation of the second supporting piece 21 of the second contact element 3 is controlled between an initial position and the second rod-shaped base portion 20, and the second supporting piece does not move in a direction away from the second rod-shaped base portion 20, a thickness of the housing can be made thin to thereby downsize the entire electrical connector. In addition, according to the present invention, a novel electrical connector by a request of the industrial field can be provided.

Although the present invention has been described using the embodiments as above, the present invention is not limited thereto, and an appropriate addition, modification and the like can be made within a gist of the present invention.

The invention claimed is:

1. An electrical connector comprising:

a first contact element provided with a first rod-shaped base portion, a first supporting piece having a base end in the vicinity of one end portion of the first rod-shaped base portion and extending in the direction of the other end portion of said first rod-shaped portion while spaced from the first rod-shaped base portion via an upwardly extending support portion, a first leg portion extending from a terminal end portion of said first supporting piece in the direction of the other end portion of the first rod-shaped base portion, and a second leg portion extending from the terminal end portion of said first supporting piece in the direction of the one end portion of the first rod-shaped base portion;

a second contact element provided with a second rod-shaped base portion, and a second supporting piece having a terminal end portion extending in the direction of the other end portion of said second rod-shaped portion while spaced from the second rod-shaped base portion via an upwardly extending support portion having a base end in the vicinity of one end portion of the second rod-shaped base portion, a housing into which the first contact element and the second contact element are inserted; and a rotating actuator comprising a shaft portion detained against the first leg portion on a lower side, and a moving portion that locks with an upper side of the vicinity of the terminal end portion of said second supporting piece upon rotation about said shaft portion;

wherein said rotation causes said moving portion to press against the vicinity of the terminal end portion of said second supporting piece and a reactive force against the pressing force causes said shaft portion to move upward.

2. An electrical connector in accordance with claim 1, wherein the terminal end portion of the second leg portion moves downward due to the upward movement of the shaft portion.

3. An electrical connector in accordance with claim 1, wherein the first contact element and the second contact element are inserted from opposite directions.

4. An electrical connector in accordance with claim 1, wherein said first contact element and second contact element are arranged so as to form a staggered array of contacts at positions that are spaced from each other in the direction of insertion into the housing.

5. An electrical connector in accordance with claim 4, wherein said housing has an insertion port for insertion of a ribbon-shaped element, and said array of contacts is such that the contacts of the first contact elements are positioned further in a direction of insertion of the ribbon-shaped element with respect to the contacts of the second contact elements.

* * * * *